US008500358B1

(12) United States Patent
Cassidy

(10) Patent No.: US 8,500,358 B1
(45) Date of Patent: Aug. 6, 2013

(54) QUICK DISCONNECT COUPLING

(75) Inventor: John M. Cassidy, Otsego, MN (US)

(73) Assignee: Torque Fitness, LLC, Andover, MN (US)

( * ) Notice: Subject to any disclaimer, the term of this patent is extended or adjusted under 35 U.S.C. 154(b) by 1035 days.

(21) Appl. No.: 11/832,241

(22) Filed: Aug. 1, 2007

Related U.S. Application Data

(60) Provisional application No. 60/820,975, filed on Aug. 1, 2006.

(51) Int. Cl.
*B25G 3/18* (2006.01)
*F16B 21/00* (2006.01)
*F16D 1/00* (2006.01)

(52) U.S. Cl.
USPC ..... 403/322.2; 403/325; 482/126

(58) Field of Classification Search
USPC ..... 403/360–362, 379.5, 322.2, 325; 482/126; 279/79, 80, 93, 94
See application file for complete search history.

(56) References Cited

U.S. PATENT DOCUMENTS

| | | | | | |
|---|---|---|---|---|---|
| 332,989 | A | | 12/1885 | Benedict | |
| 1,653,762 | A | * | 12/1927 | Fegley et al. | 279/82 |
| 2,632,645 | A | | 3/1953 | Barkschat | |
| 3,313,561 | A | * | 4/1967 | Kirilouckas | 403/361 |
| 3,396,993 | A | * | 8/1968 | Weinhold | 285/114 |
| 3,874,657 | A | | 4/1975 | Niebojewski | |
| 4,169,686 | A | | 10/1979 | Balensiefen et al. | |
| 4,431,181 | A | | 2/1984 | Baswell | |
| 4,701,083 | A | * | 10/1987 | Deutschenbaur et al. | 408/240 |
| 5,718,657 | A | | 2/1998 | Dalebout et al. | |
| 5,718,658 | A | | 2/1998 | Miller et al. | |
| 6,053,675 | A | * | 4/2000 | Holland et al. | 408/239 R |
| 6,247,272 | B1 | | 6/2001 | Shipman | |
| 6,315,488 | B1 | * | 11/2001 | Parker | 403/329 |
| 6,568,382 | B2 | * | 5/2003 | Martin et al. | 124/86 |
| 6,689,023 | B2 | | 2/2004 | Baumler | |
| 6,935,637 | B2 | * | 8/2005 | Cantlon | 279/75 |
| 7,115,079 | B2 | * | 10/2006 | Yu | 482/126 |
| 2007/0143948 | A1 | * | 6/2007 | Cayzac | 15/250.34 |

* cited by examiner

*Primary Examiner* — Michael P Ferguson
*Assistant Examiner* — Nahid Amiri
(74) *Attorney, Agent, or Firm* — Sherrill Law Offices, PLLC

(57) ABSTRACT

A quick disconnect system including a matable coupling and post. The coupling includes a base, a pair of pins, a jacket and a biasing means. The base defines a longitudinally extending bore. The pair of pins are radially repositionable relative to the bore and extend tangentially along opposite sides of the bore. The jacket cooperatively engages the base and the pins whereby longitudinal repositioning of the jacket as between a first stop position and a second stop position effects radial repositioning of the pins. The biasing means biases the jacket towards the first stop position. The post has a flanged head on the distal end of a shaft for cooperatively engaging the pins to achieve connection of the coupling and the post.

5 Claims, 8 Drawing Sheets

QUICK DISCONNECT COUPLING

This application claims the benefit of U.S. Provisional Application No. 60/820,975, filed Aug. 1, 2006.

BACKGROUND

Strength training equipment typically employs an exercise interface unit connected to a means of resistance, such as a weight stack or selecterizable series of leaf springs. Common exercise interface units include specifically, but not exclusively tricep straps, grip handles, tricep press down V bars, stirrup handles, chinning triangles, straight bars, double stirrup handles, curl bars, tricep ropes, straight lat bars, head harnesses, single cable handles, lat pull down bars, ankle cuffs, foot cuffs, and shoulder cuffs.

It is often desirable to provide several different interchangeable exercise interface units for use with a single weight stack for purposes of increasing the versatility of the machine without significantly increasing the cost of the machine. While generally effective, experience has shown that users of such equipment tend to become frustrated with and eventually stop using such machines unless the method of interchanging the exercise interface units is quick, easy and intuitive.

Accordingly, a need exists for an inexpensive yet reliable and intuitively operable device capable of permitting quick and easy connection and disconnection of various exercise interface units to a weight stack.

SUMMARY OF THE INVENTION

A first aspect of the invention is a quick disconnect coupling. A first embodiment of the quick disconnect coupling includes a base, a pair of pins, a jacket and a biasing means. The base has a longitudinally extending bore defining a longitudinal axis. The pair of pins extend tangentially along opposite sides of the bore, with at least one of the pins radially repositionable relative to the longitudinal axis. The jacket cooperatively engages the base and the pins whereby longitudinal repositioning of the jacket as between a first stop position and a second stop position effects radial repositioning of the at least one repositionable pin from a radial position nearer the longitudinal axis with both pins extending transversely across the bore, to a radial position further from the longitudinal axis. The biasing means biases the jacket towards the first stop position.

A second embodiment of the quick disconnect coupling includes a base, a sleeve, a jacket, a pair of pins and a spring. The base defines a longitudinally extending open-top chamber. The sleeve is fixedly attached to the base within the open-top chamber and has (A) a longitudinally extending bore defining a longitudinal axis from which radial and transverse directions are established, and (B) a pair of diametrically opposed, mirror image, transversely extending, tangential channels extending completely through an upper portion of the sleeve, each in communication with the bore and having a width extending in both the radial and longitudinal directions. The jacket defines a longitudinally extending open-bottom chamber configured and arranged to slidably surround the upper portion of the sleeve, and has (A) an opening through the top of the jacket axially aligned with the bore defined by the sleeve, and (B) a pair of diametrically opposed, mirror image, circumferentially extending slots through the jacket, each in communication with one end of both channels in the sleeve. The pins each extend through one of the channels in the sleeve and into both slots in the jacket, wherein longitudinal repositioning of the jacket as between a first position and a second position effects radial repositioning of the pins from a radial position nearer the longitudinal axis with both pins extending transversely across the bore, to a radial position further from the longitudinal axis. The spring biases the jacket towards the first stop position.

A second aspect of the invention is a quick disconnect system including a matable coupling and post. A first embodiment of the system includes the first embodiment of the quick disconnect coupling described above and a post with a flanged head on the distal end of a shaft configured and arranged to (i) engage and separate the pins on the coupling against the bias of the biasing means when inserted into the bore, (ii) allow the biasing means to return the pins to the radial position nearer the longitudinal axis of the bore and thereby prevent withdrawal of the post from the bore after the flanged head is inserted past the pins, and (iii) permit withdrawal of the post from the bore by repositioning the jacket into the second stop position against the bias of the biasing means.

A second embodiment of the system includes the second embodiment of the quick disconnect coupling described above and a shaft with a mushroom-shaped head on the distal end of the shaft configured and arranged to (i) engage and separate the pins on the coupling against the bias of the biasing means when inserted into the bore, (ii) allow the biasing means to return the pins to the radial position nearer the longitudinal axis of the bore and thereby prevent withdrawal of the post from the bore after the mushroom-shaped head is inserted past the pins, and (iii) permit withdrawal of the post from the bore by repositioning the jacket into the second stop position against the bias of the spring.

DETAILED DESCRIPTION OF A PREFERRED EMBODIMENT

Nomenclature

10 Quick Disconnect System
100 Coupling

110 Base
111 Inner Annular Shoulder
112 Sidewall
112' Sidewall Extensions
118 Radial Orifices Through the Base
118*a* First Radial Orifice Through the Base
118*b* Second Radial Orifice Through the Base
119 Chamber Defined by the Base
120 Jacket
121 Inner Annular Shoulder
122 Sidewall
122' Sidewall Extensions
127 Slots
127*a* First Slot
127*b* Second Slot
128 Longitudinal Orifice Through the Jacket
129 Chamber Defined by the Jacket
130 Sleeve
136 Cable End-Cap Retention Channel
137 Tangential Channels Through the Sleeve
137*a* First Tangential Channel Through the Sleeve
137*b* Second Tangential Channel Through the Sleeve
137*w* Width of Channel
138 Threaded Radial Orifices In the Sleeve
138*a* First Threaded Radial Orifice In the Sleeve
138*b* Second Threaded Radial Orifice In the Sleeve
139 Bore in Sleeve
140 Pins
140*a* First Pin
140*b* Second Pin
150 Spring
160 Machine Screws
160*a* First Machine Screw
160*b* Second Machine Screw
200 Post
201 Shaft
201*p* Proximal End of Shaft
201*d* Distal End of Shaft
210 Connection Ring on Proximal End of Shaft
220 Flanged Head on Distal End of Shaft
221 Leading Face of Head
222 Backside of Head
300 Exercise Interface Unit
310 Interconnecting Straps
320 Handgrip
400 Cable
410 End Cap on Cable
420 Weight Stack
y Longitude
$y_1$ First Longitudinal Direction
$y_2$ Second Longitudinal Direction
$y_{Axis}$ Longitudinal Axis of Bore

DEFINITIONS

As utilized herein, including the claims, the term "tangential" means following a straight line perpendicular to the radius.

Construction

The quick disconnect system 10 includes a coupling 100 and a post 200 capable of providing a strong and reliable connection.

Figure 1:
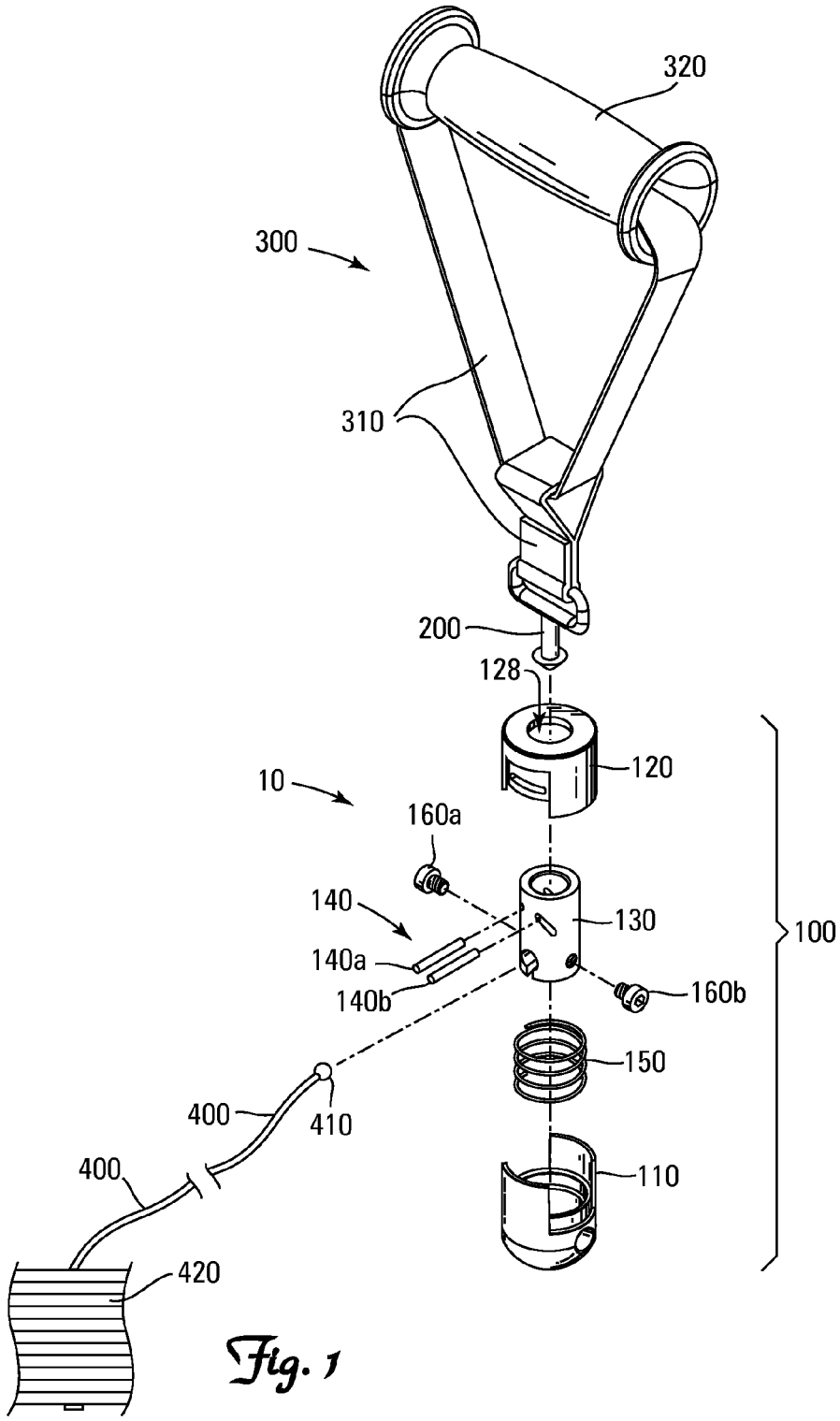
FIG. 1 is an exploded perspective view of one embodiment of the invention.

One embodiment of the coupling 100, depicted in FIG. 1, includes a base 110, a jacket 120, a sleeve 130, a pair of pins 140*a* and 140*b* (collectively pins 140), a spring 150, and a pair of machine screws 160*a* and 160*b* (collectively machine screws 160).

Figure 2:
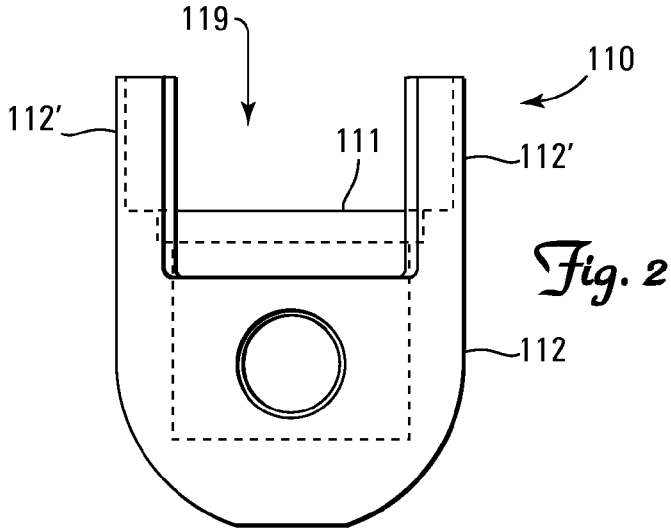
FIG. 2 is a side view of the base component of the invention shown in FIG. 1.

Referring to FIG. 2, the base 110 has a sidewall 112 defining a chamber 119 open in a first longitudinal direction $y_1$ capable of accommodating insertion of a lower portion (unnumbered) of the sleeve 130. An inner annular shoulder 111 is provided for supporting the lower end (unnumbered) of the biasing spring 150.

Figure 3:
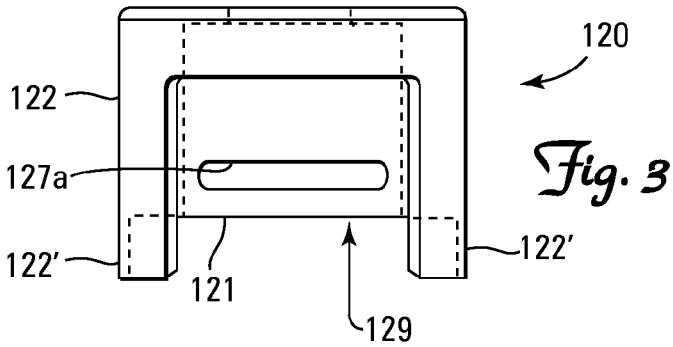
FIG. 3 is a side view of the jacket component of the invention shown in FIG. 1.

Referring to FIG. 3, in similar fashion the jacket 120 has a sidewall 122 defining a chamber 129 open in a second longitudinal directions $y_2$ capable of accommodating insertion of an upper portion (unnumbered) of the sleeve 130. An inner annular shoulder 121 is provided for supporting the upper end (unnumbered) of the biasing spring 150.

A longitudinally y extending orifice 128 is provided through the top of the jacket 120 and a pair of diametrically opposed, mirror image, circumferentially extending slots 127*a* and 127*b* (collectively slots 127) extend through the sidewall 122 of the jacket 120.

The base 110 and jacket 120 can each include a pair of diametrically opposed and longitudinally y extending sidewall extensions 112' and 122' respectively. The sidewall extensions 112' on the base 110 can cooperatively engage recessed areas (unnumbered) on the sidewall 122 of the jacket, and the sidewall extensions 122' on the jacket 120 cooperatively engage recessed areas (unnumbered) on the sidewall 112 of the base 110, for providing a fitted longitudinal y sliding engagement of the base 110 and the jacket 120.

Figure 4:
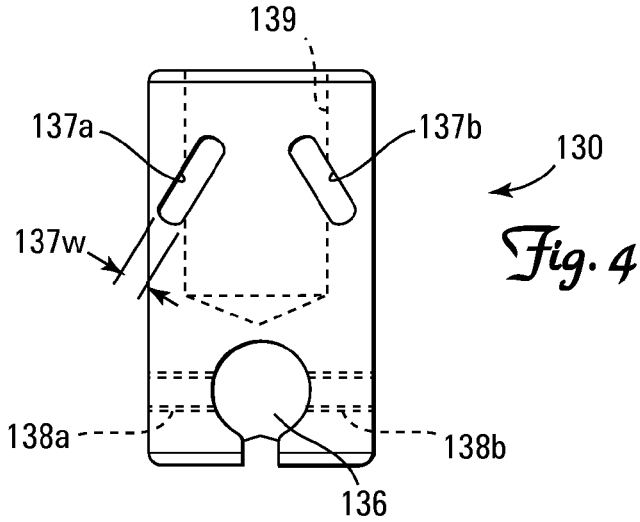
FIG. 4 is a side view of the sleeve component of the invention shown in FIG. 1.
Figure 5:
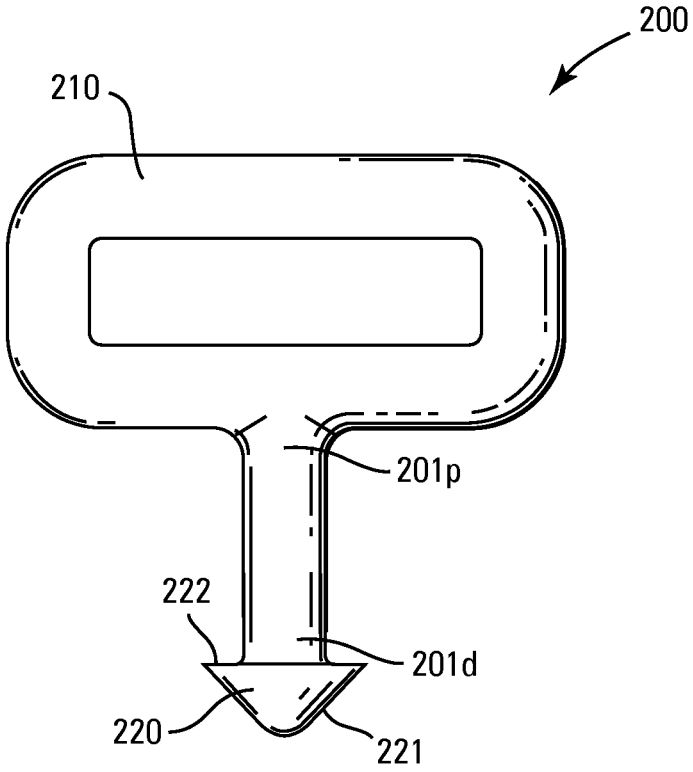
FIG. 5 is a side view of the post component of the invention shown in FIG. 1.

Referring to FIG. 4, the sleeve 130 is configured and arranged for retention within the chambers 119 and 129 defined by the base 110 and jacket 120 respectively. A longitudinal bore 139 defining a longitudinal axis $y_{axis}$ and open in the first longitudinal direction $y_1$ is provided in the sleeve 130.

Referring to FIG. 1, the sleeve 130 is attached to the base 110 by any suitable means so that the sleeve 130 cannot move in the longitudinal y direction relative to the base 110. One such attachment means, depicted in FIG. 1, is a pair of machine screws 160, each extending into a radial orifice 118*a* or 118*b* (collectively radial orifices 118) provided on either side of the base 110 and threadably engaged within a corresponding radial orifice 138*a* or 138*b* (collectively radial orifices 138) in the sleeve 130.

Referring again to FIG. 4, the sleeve 130 includes a pair of diametrically opposed, mirror image, transversely widened, tangential channels 137*a* and 137*b* (collectively 137) extending completely through the upper portion (unnumbered) of the sleeve 130. The channels 137 communicate with the bore 139 in the sleeve 130 and have a width 137*w* with both a radial and a longitudinal y directional component. The slots 127 in the jacket 120 and the tangential channels 137 in the sleeve 130 are configured and arranged so that each slot 127 in the jacket 120 aligns with one end (unnumbered) of both tangential channels 137 in the sleeve 130.

Figure 6A:
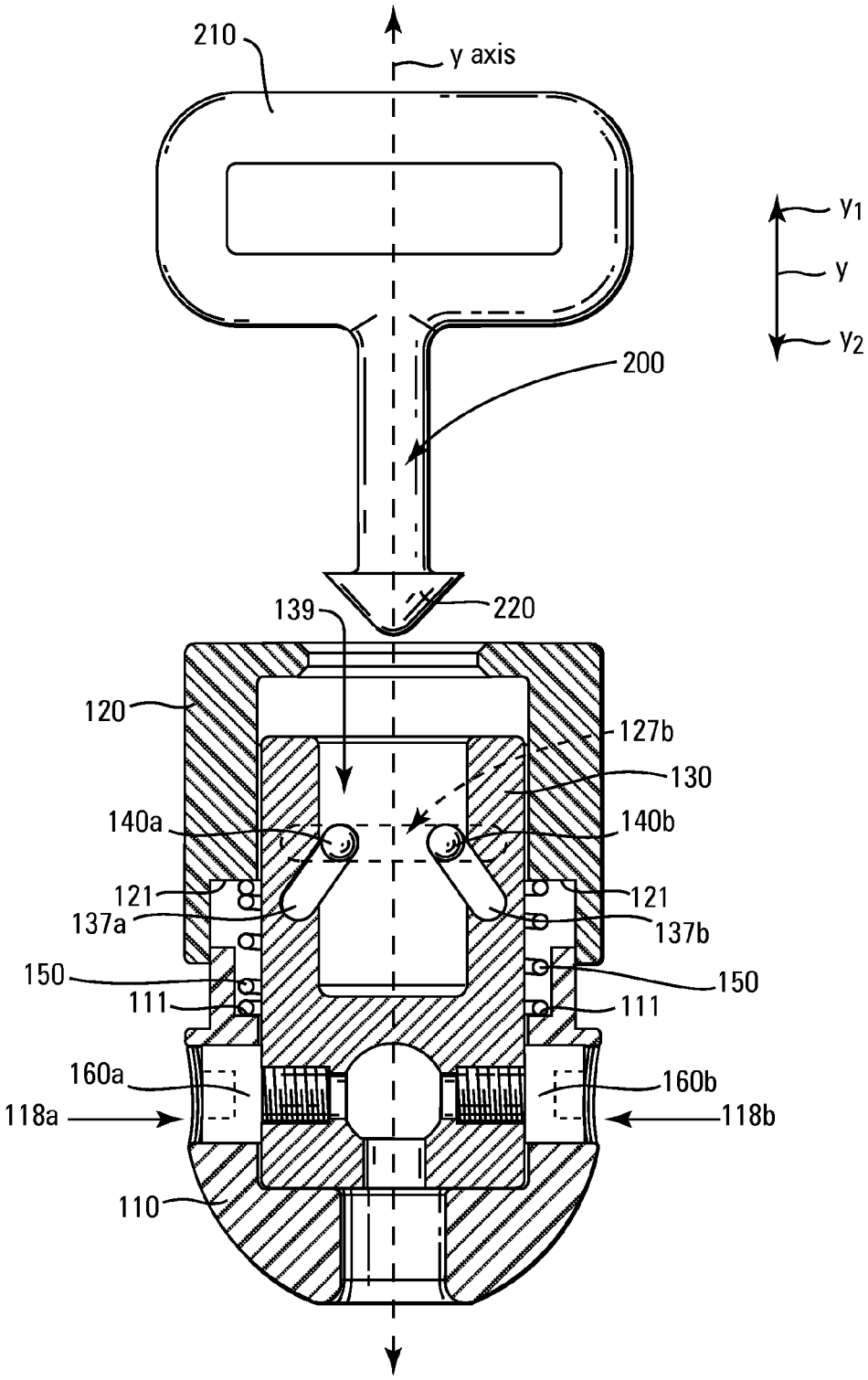
FIG. 6A is a cross-sectional view of the quick disconnection system shown in FIG. 1 prior to insertion of the post into the coupling.
Figure 6B:
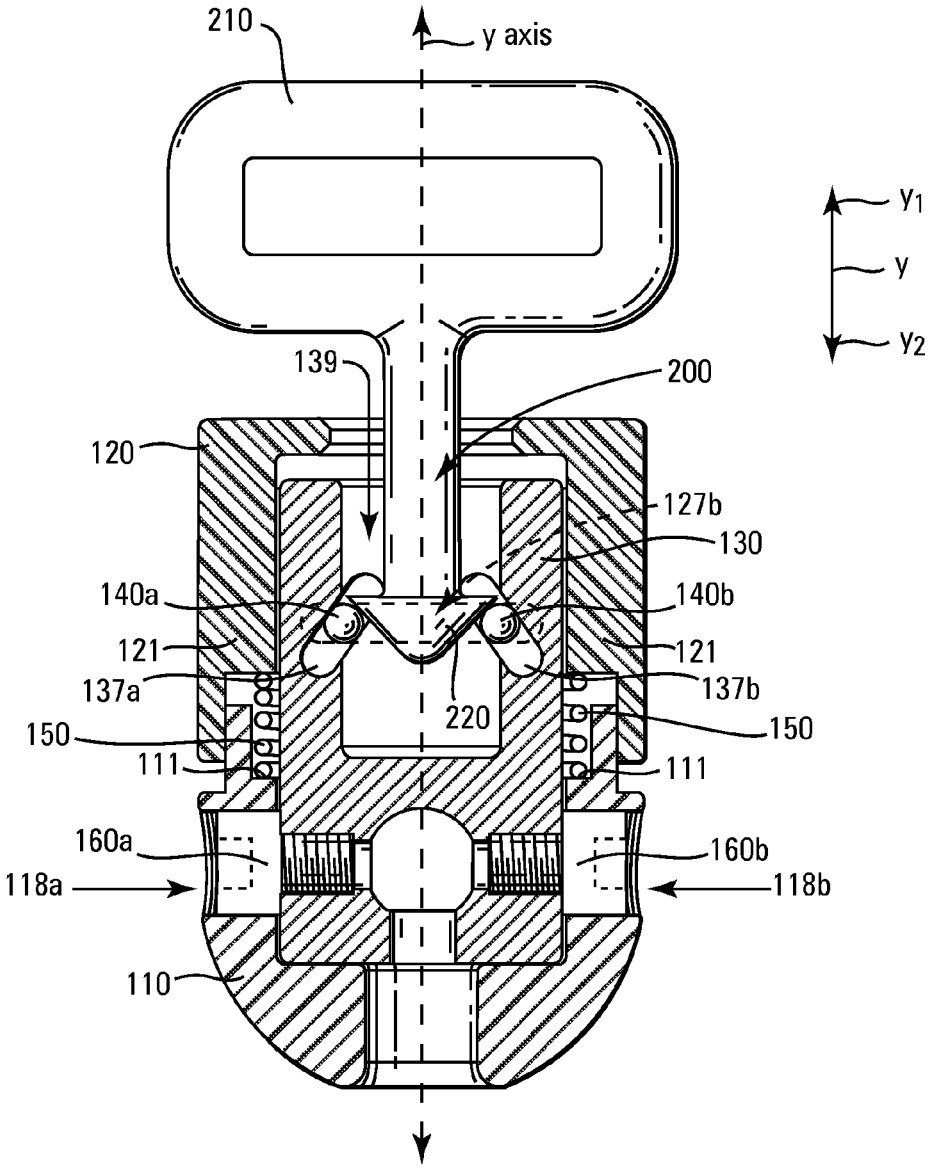
FIG. 6B is the quick disconnection system shown in FIG. 6A with the post partially inserted into the coupling.
Figure 6C:
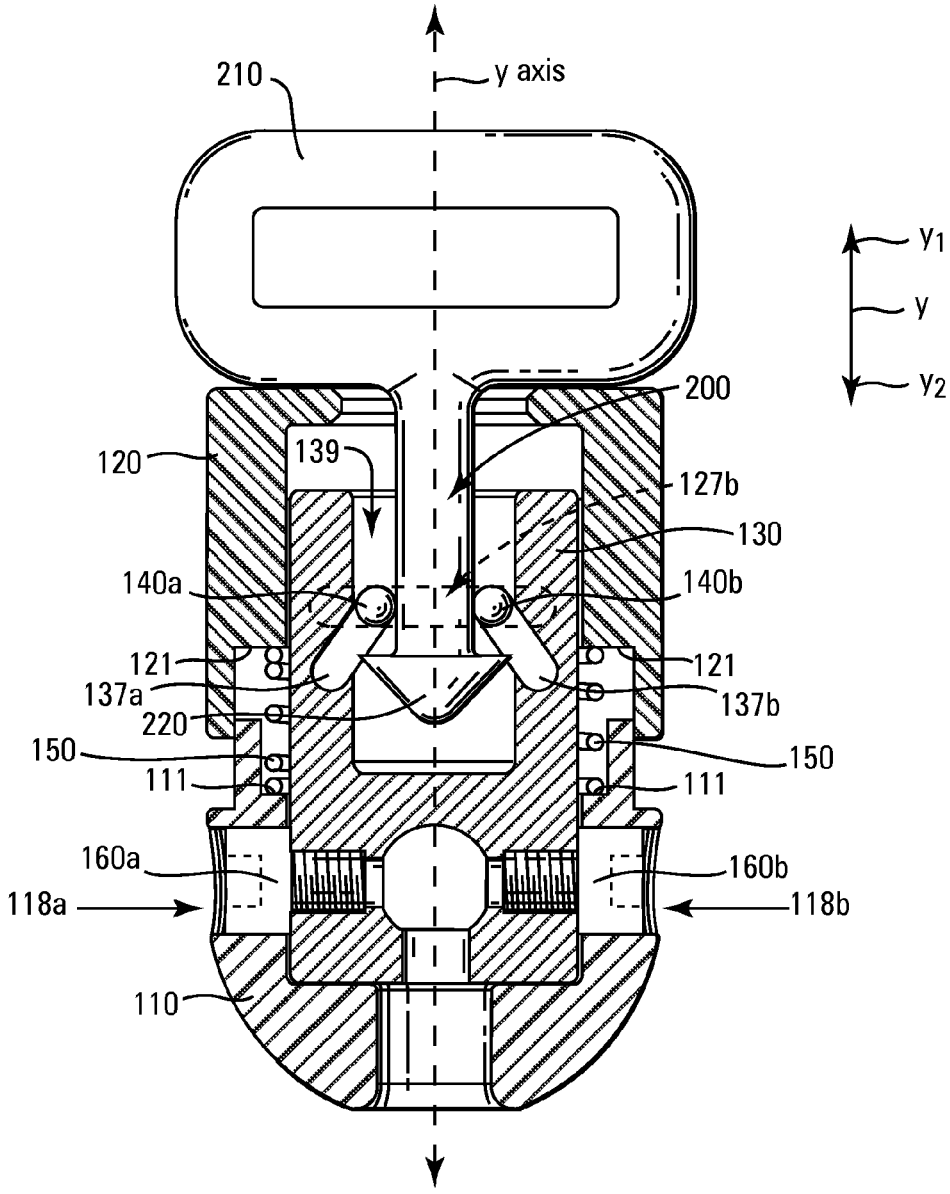
FIG. 6C is the quick disconnection system shown in FIG. 6A with the post completely inserted into the coupling.
Figure 6D:
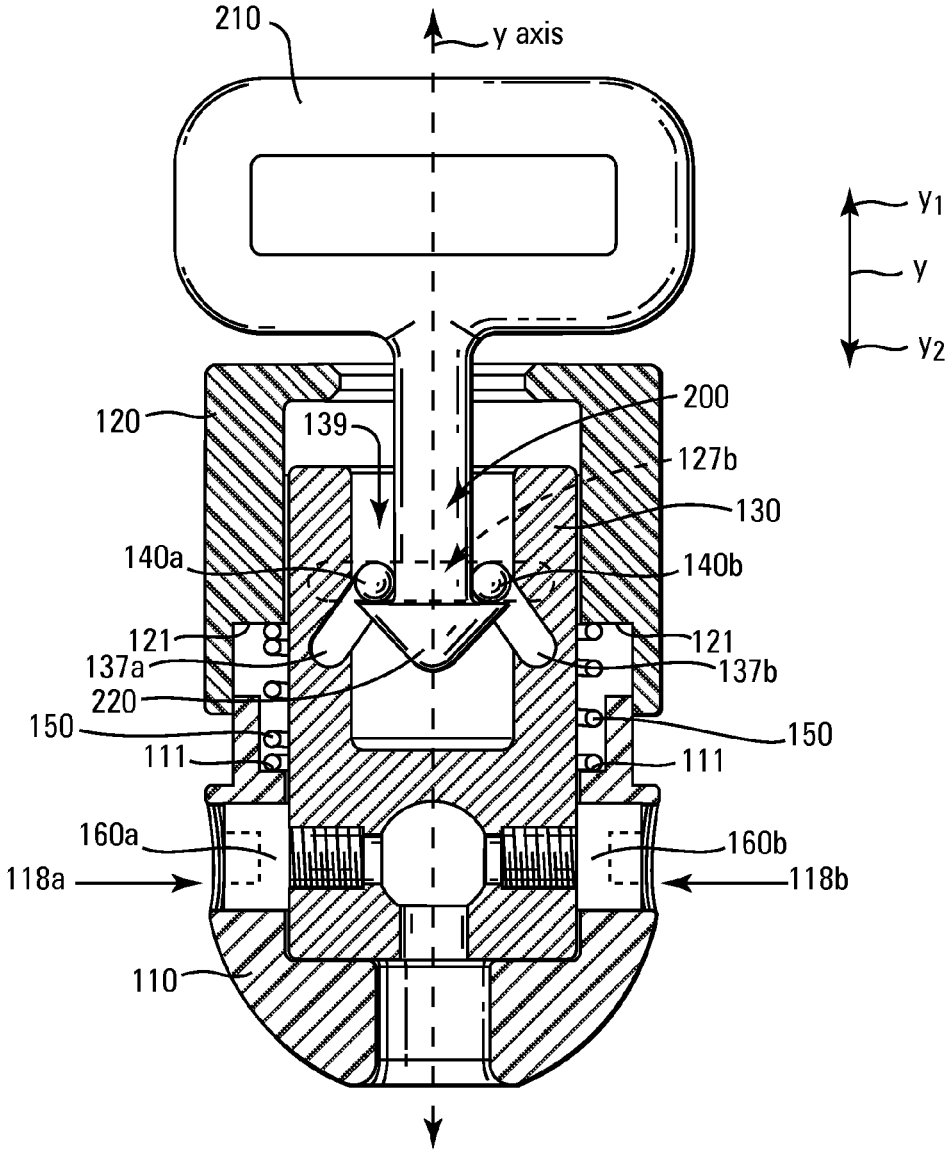
FIG. 6D is the quick disconnection system shown in FIG. 6A with the head on the post engaging the pins after complete insertion of the post into the coupling.
Figure 6E:
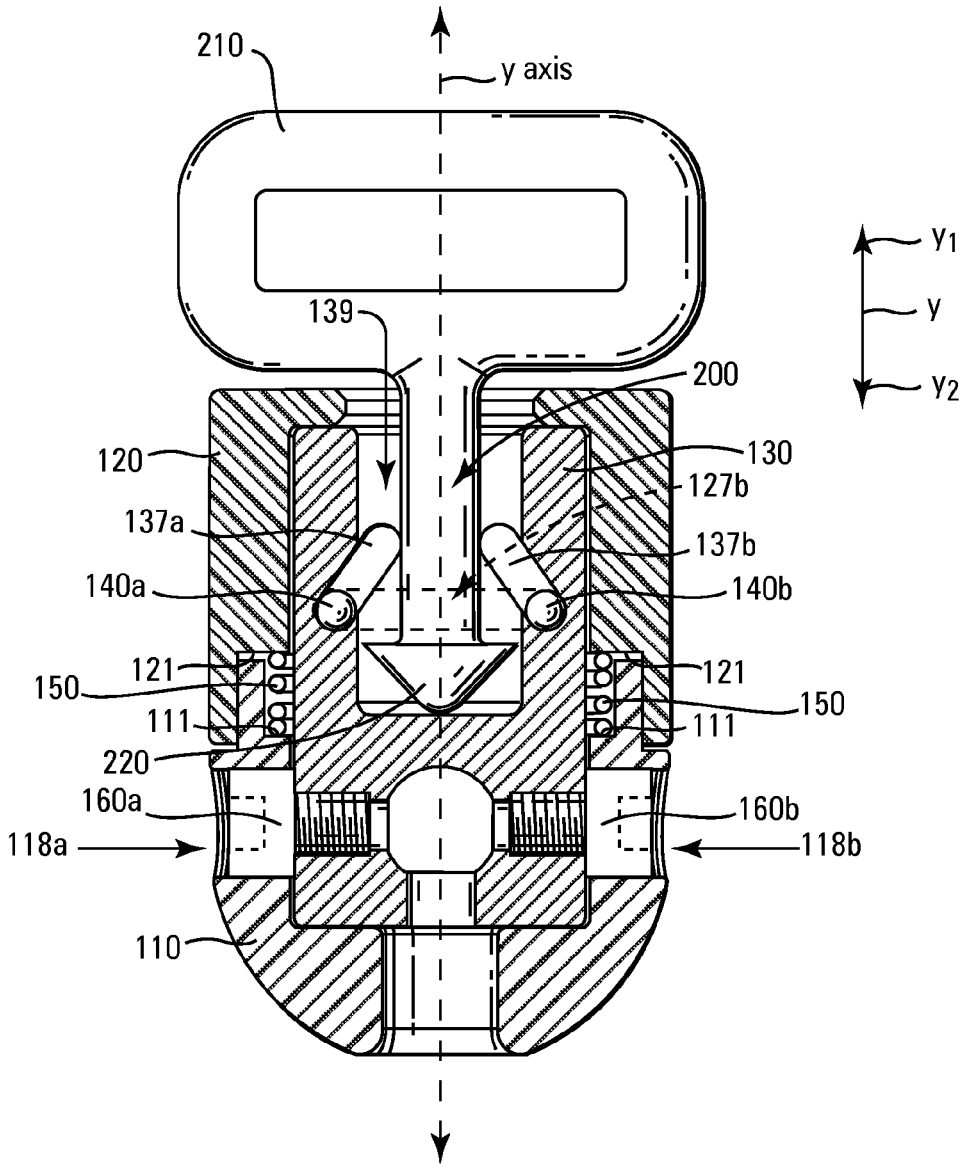
FIG. 6E is the quick disconnection system shown in FIG. 6A with the jacket pushed towards the base against the bias of the spring, causing the pins to move away from the longitudinal axis of the bore, and before the post is pulled from the bore.

Referring to FIGS. 1 and 6A-E, each pin 140 extends through one of the tangential channels 137 in the sleeve 130 and into both slots 127 in the jacket 120. The pins 140 are prevented from tangentially sliding out of the tangential channels 137 by the sidewall extensions 112' on the base 110 which cover the slots 127. The longitudinally y extending component of the tangential channels 137 permits limited longitudinal repositioning of the pins 140 and the interconnected jacket 120 as between a first longitudinal position, shown in FIG. 6A and a second longitudinal position, shown in FIG. 6E. The radially extending component of the tangential channels 137 effects a radial repositioning of the pins 140 from a first radial position nearer the longitudinal axis $y_{Axis}$, with both pins 140 extending transversely across the bore 139 as shown in FIG. 6A, to a second radial position further from the longitudinal axis $y_{Axis}$ as shown in FIG. 6E, as the pins 140 and interconnected jacket 120 are longitudinally y repositioned from the first to the second longitudinal position.

The biasing spring 150 biases the jacket 120 and the interconnected pins 140 away from the base 110 in the first longitudinal direction $y_1$ and towards the first position depicted in FIG. 6A. Other customary biasing means can also be used including elastic bands, compression springs, leaf springs, compressible elastic dowels, etc.

One embodiment of the post 200, depicted in FIG. 1, includes a shaft 201 with a connection ring 210 in the proximal end 201*p* of the shaft 201 and a flanged head 220 on the distal end 201*d* of the shaft 201, configured and arranged for insertion through the longitudinal orifice 128 in the jacket 120, into the bore 139 of the sleeve 130 and into operable engagement with the pins 140. The flanged head 220 has an outwardly and backwardly angled leading face 221 effective for engaging and radially separating the pins 140 until the head 220 is inserted past the pins 140. The backside 222 of the head 220 is configured and arranged to engage the pins 140 once the head 220 has been inserted past the pins 140 to effect a robust and reliable connection of the post 200 to the coupling 100.

The quick disconnect system 10 is useful for robustly and reliably connecting items while providing a quick, easy and intuitive method of quickly connecting and disconnecting the items. One such application, shown in FIG. 1, uses the quick disconnect system 10 to attach an exercise interface unit 300 to a cable 400 attached to a source of resistance such as a weight stack 420. The exercise interface unit 300 includes a handgrip 320 fixedly attached to the post 200 by interconnecting straps 310. The cable 400 is fixedly attached to the coupling 100 by an end cap 410 on the cable 400 held within a cable end-cap retention channel 136 in the lower portion (unnumbered) of the sleeve 130.

Use

The process involved in connecting and disconnecting the coupling 100 and the post 200 is depicted in FIGS. 6A-6D. The fully disconnected coupling 100 and post 200 are shown in FIG. 6A. When fully disconnected, the pins 140 are biased in the first longitudinal directions $y_1$ by the spring 150 into a first position at the top of the tangential channels 137 in the sleeve 130 with the pins 140 nearer one another and extending tangentially across the bore 139.

As represented in FIGS. 6B-D, connection of the coupling 100 and post 200 is effected by simply inserting the distal end 201*d* of the shaft 201 through the longitudinal orifice 128 through the jacket 120, thereby effecting a radial separation of the pins 140 against the bias of the spring 150, shown in FIG. 6B, until the head 220 on the distal end 201*d* of the shaft 201 completely passes the pins 140, shown in FIG. 6C, at which time the pins 140 are biased by the spring 150 back towards the first position. Pulling back on the post 200 causes the backside 222 of the head 220 to engage the pins 140, thereby preventing withdrawal of the post 200 from the bore 139 and effecting a robust and reliable connection of the coupling 100 and the post 200.

Referring to FIGS. 6D and 6E, the coupling 100 and post 200 can be quickly, easily and intuitively disconnected by simply pushing the jacket 120 in the second longitudinal direction $y_2$ towards the base 110 against the bias of the spring 150, thereby moving the pins 140 from the top of the tangential channels 137 in the sleeve 130, as shown in FIG. 6D, to the bottom of the tangential channels 137 in the sleeve 130, as shown in FIG. 6E, where the pins 140 are positioned further away from one another and no longer extend tangentially across the bore 139. The post 200 may then be pulled out from the bore 139 and the jacket 120, along with the pins 140, allowed to return to the first biased position, thereby returning to the disconnected state as shown in FIG. 6A.

The invention claimed is:

1. A quick disconnect system, comprising:

(a) a coupling, comprising:

(1) a base defining a longitudinally extending open-top chamber, (2) a sleeve fixedly attached to the base within the open-top chamber and having (i) a longitudinally extending bore defining a longitudinal axis from which radial and transverse directions are established, and (ii) a pair of diametrically opposed, mirror image, transversely extending, tangential channels extending completely through an upper portion of the sleeve, each in communication with the bore and having a width extending in both the radial and longitudinal directions, (3) a jacket defining a longitudinally extending open-bottom chamber configured and arranged to slidably surround the upper portion of the sleeve, and having (i) an opening through the top of the jacket axially aligned with the bore defined by the sleeve, and (ii) a pair of diametrically opposed, mirror image, circumferentially extending slots through the jacket, each in communication with one end of both channels in the sleeve, (4) a pair of pins, each extending through one of the channels in the sleeve and into both slots in the jacket, wherein longitudinal repositioning of the jacket as between a first position and a second position effects radial repositioning of the pins from a radial position nearer the longitudinal axis with both pins extending transversely across the bore, to a radial position further from the longitudinal axis, and (5) means for biasing the jacket towards the first stop position, and (b) a post with a mushroom-shaped head on the forward end of a longitudinally extending shaft, the head having an outwardly tapered forward facing surface and a rearward facing surface, operable for (i) engaging and deflectively separating the pins against the bias of the biasing means with the forward facing surface of the head when inserted into the bore, (ii) allowing the biasing means to return the pins to the radial position nearer the longitudinal axis after the mushroom-shaped head is inserted past the pins, (iii) permitting withdrawal of the entire post completely from the bore by repositioning the jacket into the second stop position against the bias of the biasing means, and (iv) engaging the pins with the rearward facing surface of the head when the jacket is in the first position and withdrawal of the post from the bore is attempted, whereby the slope of the rearward facing surface relative to the longitudinal axis of the bore renders the head incapable of deflectively separating the pins against the bias of the biasing means with the rearward facing surface of the head, thereby locking the post within the bore until the jacket is repositioned into the second position against the bias of the biasing means.

2. The system of claim 1 wherein a source of resistance is attached to one of the coupling or the post and an exercise interface unit is attached to the other.

3. The system of claim 2 wherein the source of resistance is a weight stack.

4. The system of claim 1 wherein the shaft defines a longitudinal axis and the rearward facing surface of the head is orthogonal to the longitudinal axis of the shaft.

5. The system of claim 1 wherein the biasing means is a spring.

* * * * *